US009323207B2

(12) United States Patent
Nogami et al.

(10) Patent No.: US 9,323,207 B2
(45) Date of Patent: Apr. 26, 2016

(54) IMAGE FORMING APPARATUS

(71) Applicant: Brother Kogyo Kabushiki Kaisha, Nagoya-shi, Aichi-ken (JP)

(72) Inventors: Hidekazu Nogami, Nagoya (JP); Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,247

(22) Filed: Sep. 30, 2014

(65) Prior Publication Data

US 2015/0093142 A1 Apr. 2, 2015

(30) Foreign Application Priority Data

Sep. 30, 2013 (JP) ..... 2013-203205

(51) Int. Cl.
*G03G 21/20* (2006.01)
*G03G 15/00* (2006.01)

(52) U.S. Cl.
CPC ..... *G03G 15/6573* (2013.01); *G03G 15/6552* (2013.01); *G03G 21/206* (2013.01)

(58) Field of Classification Search
USPC ..... 399/92, 94
See application file for complete search history.

(56) References Cited

U.S. PATENT DOCUMENTS

| | | | | |
|---|---|---|---|---|
| 5,842,104 | A | 11/1998 | Hazama et al. | |
| 6,584,299 | B2 * | 6/2003 | Nomura | 399/405 |
| 2004/0131378 | A1 * | 7/2004 | Hattori et al. | 399/90 |
| 2013/0010028 | A1 * | 1/2013 | Taira | 347/25 |

FOREIGN PATENT DOCUMENTS

| | | | |
|---|---|---|---|
| JP | H07-315623 | A | 12/1995 |
| JP | H11-202738 | A | 7/1999 |
| JP | 2000-003083 | A | 1/2000 |
| JP | 2000-259064 | A | 9/2000 |
| JP | 2003-295742 | A | 10/2003 |
| JP | 2007-204185 | A | 8/2007 |
| JP | 2008-056447 | A | 3/2008 |

OTHER PUBLICATIONS

JP1999-202738 Machine Translation available from JPO website.*
JP2008-056447 Machine Translation available from JPO website.*

* cited by examiner

*Primary Examiner* — Minh Phan
(74) *Attorney, Agent, or Firm* — Banner & Witcoff, Ltd.

(57) ABSTRACT

An image forming apparatus includes a fixing unit, a housing having a sheet ejection opening, a plurality of sheet ejection rollers disposed in the sheet ejection opening and configured to eject the sheet fed from the fixing unit to the outside of the housing, a heat generating member spaced apart from the fixing unit and configured to generate heat, and a first guide member. The first guide member is disposed above the heat generating member, and configured to guide the sheet fed from the fixing unit to the ejection rollers. The first guide member includes a base portion having a plurality of outlet ports, and a plurality of ribs protruding upward from the base portion. The outlet ports are disposed between each pair of adjacent ones of the ribs and positioned closer to a downstream end of the first guide member than to an upstream end thereof.

12 Claims, 3 Drawing Sheets

IMAGE FORMING APPARATUS

CROSS REFERENCE TO RELATED APPLICATION

This application claims priority from Japanese Patent Application No. 2013-203205, filed on Sep. 30, 2013, which is incorporated herein by reference in its entirety.

TECHNICAL FIELD

Aspects of the disclosure relate to an image forming apparatus configured to discharge heat generated by a heat generating member disposed in a housing.

BACKGROUND

Some image forming apparatuses need to discharge heat generated by heat generating members such as a fixing unit.

In a known image forming apparatus, heat generated by a heat source unit is discharged by natural convection by disposing one end of a duct in a vicinity of the heat source unit and disposing the other end of the duct in a portion above the heat source unit.

SUMMARY

However, in a case in which heat generated by a fixing unit as a heat source unit is discharged by natural convection, sufficient flow of air may not be created.

Accordingly, in a case in which a heat generating member, such as a substrate, other than the heat source unit, is disposed in a portion where flow of air is not sufficient, heat generated by the heat generating member may not be discharged sufficiently.

The disclosure is made in view of the background described above, and an object thereof is to efficiently discharge heat inside a housing.

According to an aspect of the disclosure, an image forming apparatus configured to form an image on a sheet may include a fixing unit, a housing accommodating the fixing unit, a plurality of sheet ejection rollers, a heat generating member, and a first guide member. The fixing unit is configured to fix a toner image formed on the sheet S by heat. The housing has a sheet ejection opening through which the sheet is ejected to an outside of the housing. The housing defines a sheet ejection path through which the sheet passes. The sheet ejection path extends from the fixing unit to the sheet ejection opening. The sheet ejection rollers are disposed in the sheet ejection opening and configured to eject the sheet fed from the fixing unit to the outside of the housing. The heat generating member is spaced apart from the fixing unit and disposed below the sheet ejection path. The heat generating member is configured to generate heat. The first guide member is disposed above the heat generating member and defines a lower side of the sheet ejection path. The first guide is configured to guide the sheet fed from the fixing unit to the ejection rollers. The first guide member includes a base portion having a plurality of outlet ports, and a plurality of ribs protruding upward from the base portion and extending along the sheet ejection path, the ribs being configured to guide the sheet passing through the sheet ejection path. The outlet ports are disposed between each pair of adjacent ones of the ribs and positioned closer to a downstream end of the first guide member than to an upstream end thereof.

With the structures described above, air heated by the heat from the fixing unit flows into the sheet ejection path by natural convection and is then discharged to the outside of the housing. In addition, the air moves together with the sheet passing through the sheet ejection path. Thus, the air in the housing can be effectively discharged to the outside of the housing.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION

Figure 1:
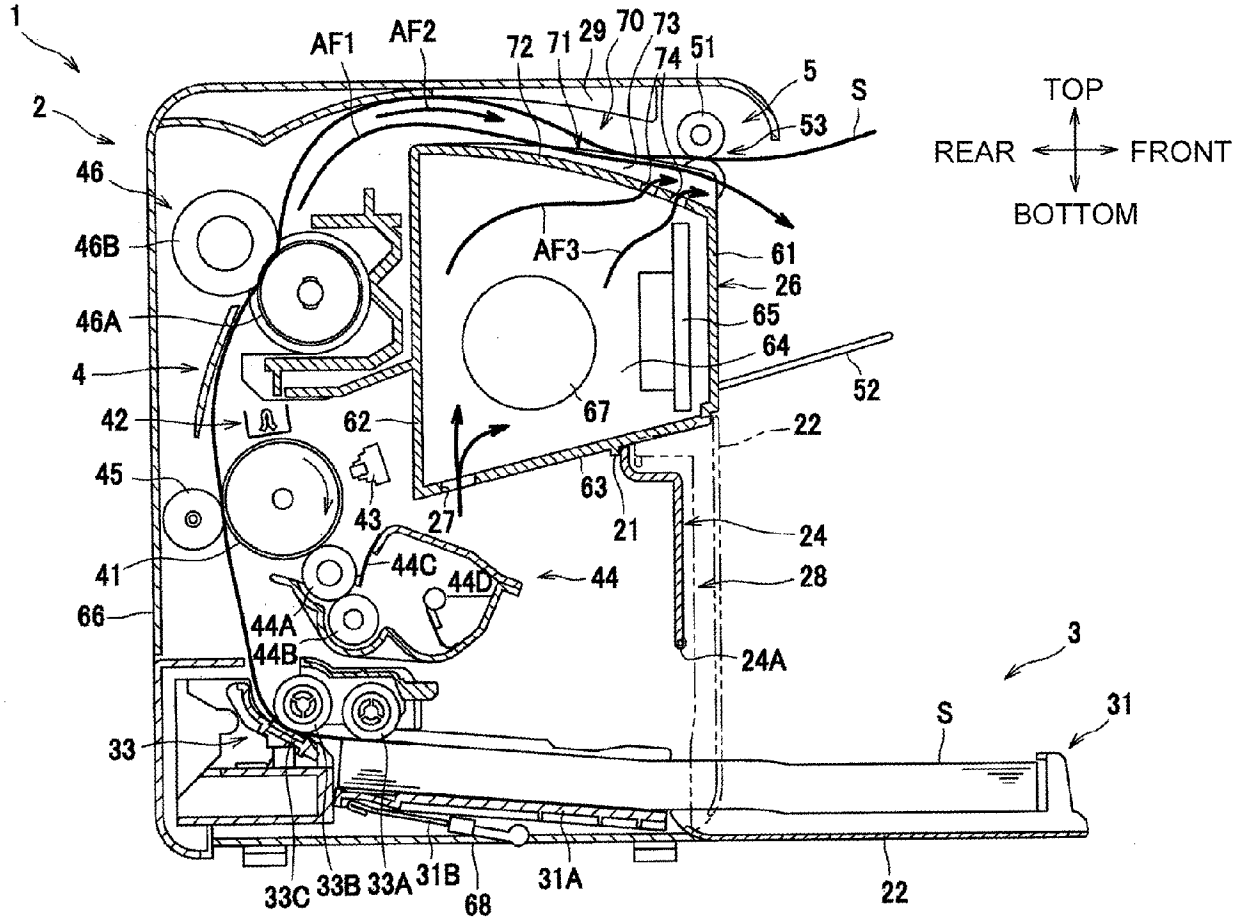
FIG. 1 is a diagram illustrating an overall configuration of a laser printer as an example of an image forming apparatus according to an embodiment of the disclosure.

An illustrative embodiment of the disclosure will be described next while referring to the drawings as required. In the following description, the expressions "front", "rear", "upper or top", "lower or bottom", "right", and "left" are used to define the various parts when a laser printer 1 is disposed in an orientation in which it is intended to be used.

As illustrated in FIG. 1, a laser printer 1 as an example of the image forming apparatus is configured to form an image on a sheet S as an example of a recording sheet by transferring a toner image formed on a photosensitive drum 41 onto the sheet S, and mainly includes a housing 2, a sheet supply unit 3, an image forming unit 4, and a sheet ejection unit 5.

The housing 2 is a member that constitutes the exterior of the laser printer 1 and houses the image forming unit 4 therein. An opening 21 for detaching a developing cartridge 44 is formed in the front side of the housing 2.

The housing 2 mainly includes a front cover 22, a second front cover 24, a first accommodating portion 26 that defines a heat generating member accommodation space that accommodates a circuit substrate 65 and a motor 67 therein, and a second accommodating portion 28 that is adjacent to the first accommodating portion 26 and that accommodates the sheet S therein.

The front cover 22 is a cover (see the chain line) that covers the opening 21 on the front side. An upper end portion of the front cover 22 is supported in a pivotal manner with respect to the housing 2 about a lower end portion of the front cover 22, and when in an open state illustrated by the solid line, the front cover 22 constitutes a portion of a sheet supply tray 31.

A second front cover 24 is disposed inside the front cover 22 in the closed state illustrated by the chain line and opens and closes the opening 21 by pivoting about a lower end portion 24A. Accordingly, even when the front cover 22 is open and is used as a portion of the sheet supply tray 31, intrusion of dust into the housing 2 can be suppressed by the second front cover 24.

The first accommodating portion 26 is constituted by left and right walls 64 of the housing 2 (only the right side wall 64 is illustrated in FIG. 1), a front wall 61 that constitutes a portion of the housing 2, a rear wall 62, a bottom wall 63, and a base portion 72 of a first guide member 71 described later. The first accommodating portion 26 defines the heat generating member accommodation space that accommodates heat generating members, such as a circuit substrate 65 and a motor 67.

The circuit substrate 65 includes a circuit substrate body and a plurality of electronic components mounted on the circuit substrate body. The circuit substrate 65 is configured to supply a specific voltage to a charge unit 42, the developing cartridge 44, and a transfer roller 45 of the image forming unit 4.

The motor 67 is configured to supply driving force to the developing cartridge 44, a fixing unit 46, a sheet supply mechanism 33, and the like through gears (not shown) and the like.

The second accommodating portion 28 includes the left and right walls 64 of the housing 2 (only the right side wall 64 is illustrated in FIG. 1), a rear wall 66 and a bottom wall 68 of the housing 2, the bottom wall 63 of the first accommodating portion 26, and the second front cover 24 in the closed state. The second accommodating portion 28 accommodates a portion of the sheet S that is placed on the sheet supply tray 31.

The second accommodating portion 28 is adjacent to the first accommodating portion 26 and is disposed below the first accommodating portion 26. The second accommodating portion 28 accommodates the sheet supply unit 3 and the developing cartridge 44.

The heat generating member accommodation space inside the first accommodating portion 26 and the interior of the second accommodating portion 28 are in communication with each other through an inlet port 27 formed in the bottom wall 63 of the first accommodating portion 26.

The sheet supply unit 3 is configured to supply the sheet S to the image forming unit 4 and mainly includes the sheet supply tray 31 and a sheet supply mechanism 33. The sheet supply tray 31 is a tray on which the sheet S that is to be supplied to the image forming unit 4 is placed.

The sheet supply tray 31 includes a pressing plate 31A that is disposed in a lower portion of the housing 2. The pressing plate 31A and the front cover 22 in the open state constitute a base portion of the sheet supply tray 31 for placing the sheet S thereon. The pressing plate 31A is supported so as to pivot up and down with respect to the housing 2 about a front end portion of the pressing plate 31A and a rear end portion of the pressing plate 31A is pushed up by a pushing-up member 31B.

The sheet supply mechanism 33 includes a pickup roller 33A, a separation roller 33B, and a separation pad 33C, and is disposed in the lower rear portion of the housing 2.

The sheet supply mechanism 33 is configured to send out the sheets S that are placed on the sheet supply tray 31 with the pickup roller 33A, separate the sheets S one by one at a portion between the separation roller 33B and the separation pad 33C, and supply a separated sheet S to the image forming unit 4.

The image forming unit 4 is configured to form an image on the supplied sheet S and mainly includes the photosensitive drum 41, the charge unit 42, an exposure unit 43, the developing cartridge 44, the transfer roller 45, and the fixing unit 46.

The photosensitive drum 41 is a member having a photosensitive layer formed on an outer peripheral surface of a conductive cylindrical drum body and is disposed in the vicinity of the rear middle portion of the housing 2 in the top-bottom direction. The photosensitive drum 41 rotates in a direction illustrated by the arrow in FIG. 1. The photosensitive drum 41 is configured to carry a toner image that is an example of a developer image upon supply of toner (a developer) to an electrostatic latent image that has been formed on the outer peripheral surface of the photosensitive drum 41 by exposure.

The charge unit 42 includes a corona wire and a grid electrode, and is disposed above the photosensitive drum 41 so as to face the photosensitive drum 41. The charge unit 42 is configured to charge the surface of the photosensitive drum 41 in a uniform manner by applying a charging bias.

The exposure unit 43 includes a plurality of blinking portions (e.g. light emitting diode elements, not shown) that are arranged in the left-right direction, that is, the direction of the rotation axis of the photosensitive drum 41. The exposure unit 43 is disposed obliquely above and in front of the photosensitive drum 41 so as to face the photosensitive drum 41. The exposure unit 43 is configured to form an electrostatic latent image on the photosensitive drum 41 by exposing the charged photosensitive drum 41 by blinking the blinking portions according to an image data.

The developing cartridge 44 includes a developing roller 44A, a supply roller 44B, a layer thickness regulating blade 44C, and a toner storing portion 44D in which the toner is stored. The developing cartridge 44 is disposed obliquely below and in front of the photosensitive drum 41 so as to face the photosensitive drum 41.

The developing cartridge 44 is configured such that toner is supplied to the electrostatic latent image formed, by exposing, on the photosensitive drum 41 so as to form a toner image on the photosensitive drum 41. By opening the front cover 22 and the second front cover 24, the developing cartridge 44 can be detached from the housing 2 through the opening 21.

The transfer roller 45 is disposed behind the photosensitive drum 41 so as to face the photosensitive drum 41. The transfer roller 45 is configured to draw the toner thereto by applying a transfer bias so as to transfer the toner image onto the sheet S that passes between the photosensitive drum 41 and the transfer roller 45.

The fixing unit 46 includes a heating roller 46A and a pressure roller 46B, and is disposed above the photosensitive drum 41 in the housing 2. The fixing unit 46 is configured to fix the toner image formed on the sheet S by heat when the sheet S passes between the heating roller 46A and the pressure roller 46B.

The sheet ejection unit 5 is configured to eject the sheet S on which the toner image has been fixed by heat at the fixing unit 46 to the outside of the housing 2, and mainly includes sheet ejection rollers 51, an ejection tray 52, and a sheet ejection opening 53.

The sheet ejection rollers 51 are rollers configured to eject the sheet S fed from the fixing unit 46 to the outside of the housing 2 and are disposed in the upper portion inside the housing 2.

The ejection tray 52 is a tray for receiving the sheet S ejected to the outside of the housing 2 and protrudes from the front side of the housing 2.

The sheet ejection opening 53 communicates the inside of the housing 2 with the outside of the housing 2 and is an opening through which the sheet S ejected by the sheet ejection rollers 51 passes.

The laser printer 1 configured as above performs an image forming operation when an image forming command including image data is input thereto.

Specifically, in the image forming unit 4, the surface of the rotationally driven photosensitive drum 41 is charged at the charge unit 42, the charged surface of the photosensitive drum 41 is exposed at the exposure unit 43, and an electrostatic latent image based on image data is formed on the photosensitive drum 41. Then, at the developing cartridge 44, toner is supplied to the exposed photosensitive drum 41 such that the electrostatic latent image is visualized as a toner image on the photosensitive drum 41.

Furthermore, during the above operation, in the sheet supply unit 3, the sheet S received on the sheet supply tray 31 is supplied to the image forming unit 4 with the sheet supply mechanism 33 at an appropriate timing. Moreover, in the image forming unit 4, the toner image carried on the photosensitive drum 41 is transferred onto the sheet S, which has been supplied from the sheet supply unit 3, when the sheet S passes between the photosensitive drum 41 and the transfer roller 45.

Then, the toner image transferred to the sheet S is thermally fixed at the fixing unit 46. Then, in the sheet ejection unit 5, the sheet Shaving the toner image thermally fixed thereon is ejected to the outside of the housing 2 by the sheet ejection rollers 51 and received on the ejection tray 52.

A sheet ejection path 70 that connects the fixing unit 46 and the sheet ejection opening 53 to each other is formed inside the housing 2. A sheet S having a toner image thermally fixed thereon passes through the sheet ejection path 70.

The first guide member 71 defines a lower side of the sheet ejection path 70.

As illustrated in FIG. 1, the first guide member 71 is disposed between the circuit substrate 65 and the motor 67, and the sheet ejection path 70. The first guide member 71 faces the sheet S that passes through the sheet ejection path 70 and includes a base portion 72. The base portion 72 connects the front wall 61 and the rear wall 62 to each other and serves as an upper wall of the first accommodating portion 26.

Furthermore, the first guide member 71 includes a plurality of ribs 73 that protrude upwards from the base portion 72 and that extend along the sheet ejection path 70. The first guide member 71 has a plurality of outlet ports 74 in the base portion 72. The outlet ports 74 are disposed between the ribs 73. The undersurface of the sheet S, which passes through the sheet ejection path 70, comes in contact with upper surfaces of the plurality of ribs 73. Accordingly, the upper surfaces of the plurality of ribs 73 defines the lower side of the sheet ejection path 70 and function as a guide portion configured to guides the sheet S passing through the sheet ejection path 70.

Figure 2:
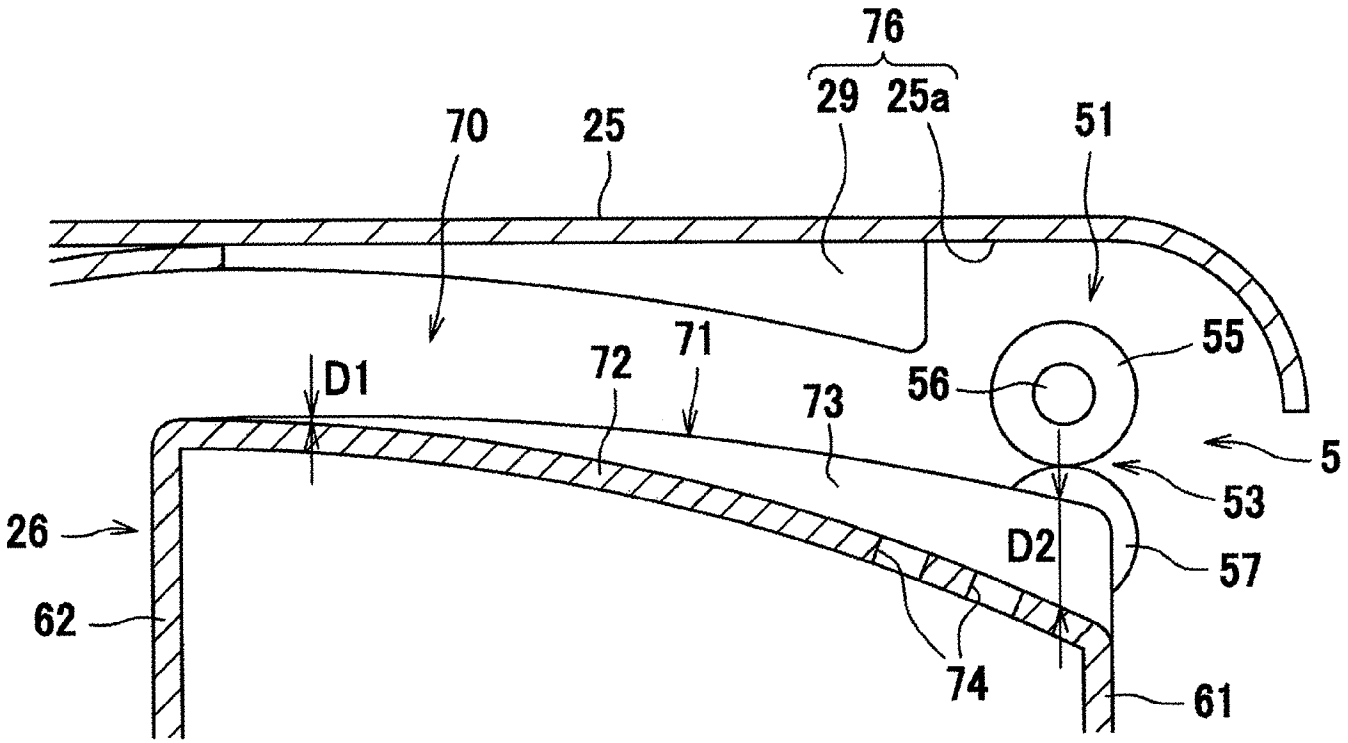
FIG. 2 is an enlarged view of a sheet ejection path of the laser printer and the vicinity thereof illustrated in FIG. 1.

More specifically, as illustrated in FIG. 2, the upper surface of the base portion 72 is a curved and inclined surface whose height gradually decreases from the rear wall 62 towards the front wall 61.

Furthermore, the protruding amount of each rib 73 from the base portion 72 is determined such that a height D2 of a downstream end of the first guide member 71 positioned toward the sheet ejection opening 53 (an end positioned downstream with respect to the feeding direction of the sheet S) is higher than a height D1 of an upstream end of the first guide member positioned toward the fixing unit 46 (an end positioned upstream with respect to the feeding direction of the sheet S).

Furthermore, regarding the whole shape of the first guide member 71, the guide portion, which is made up of the upper surfaces of the ribs 73, is gradually inclined downwards from near the fixing unit 46 towards the sheet ejection opening 53. Accordingly, the first guide member 71 smoothly guides the sheet S passing through the sheet ejection path 70 towards the sheet ejection rollers 51.

As illustrated in FIG. 1, the fixing unit 46 is disposed in a rear portion of the housing 2 and the sheet ejection opening 53 is open towards the front of the housing 2. Furthermore, the first accommodating portion 26 is disposed between the fixing unit 46 and the sheet ejection opening 53. The circuit substrate 65 and the motor 67 are partitioned from the fixing unit 46 with the rear wall 62 that has no openings therein.

Figure 3:
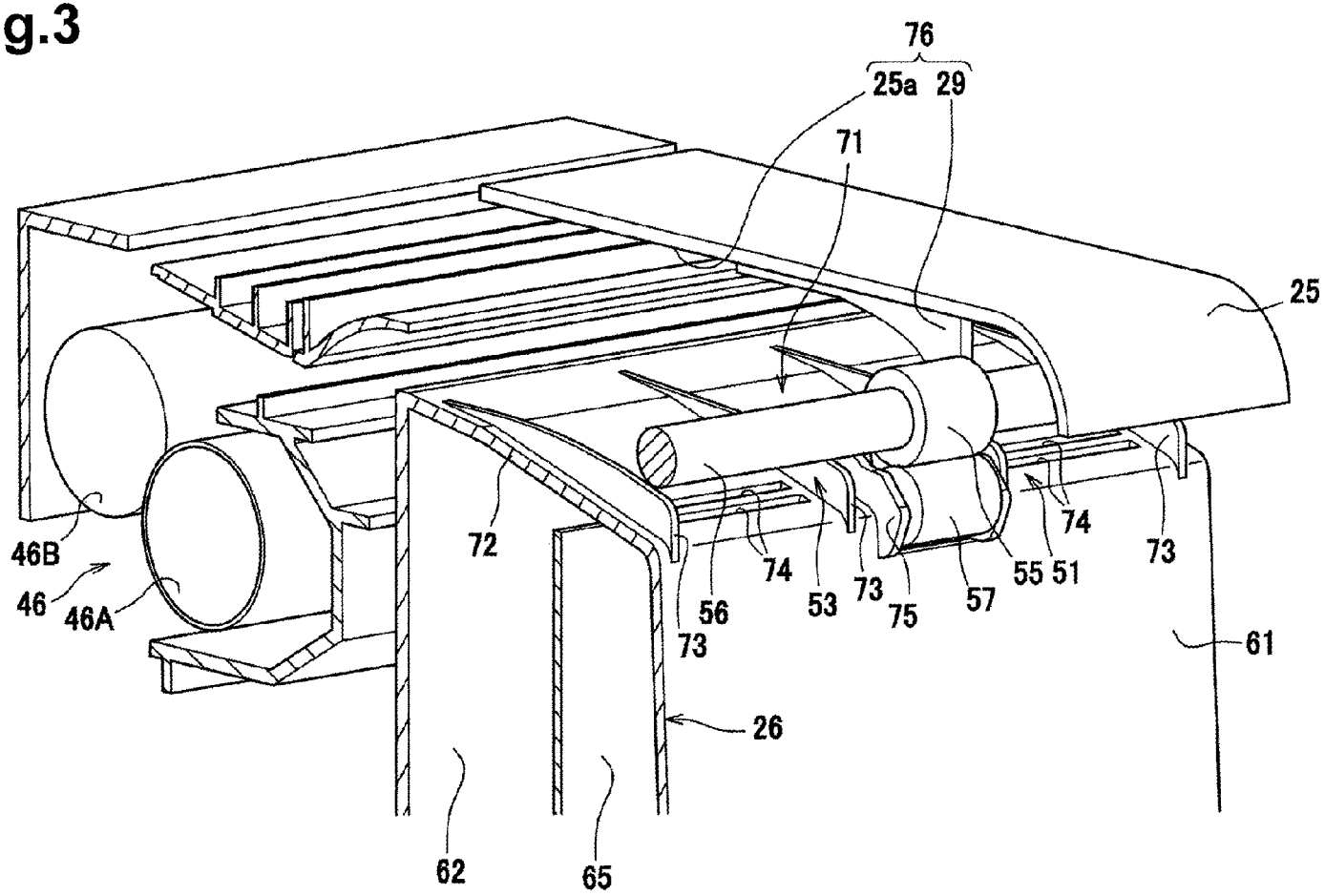
FIG. 3 is a partially cross-sectional perspective view illustrating a structure around the sheet ejection path of the laser printer.

As illustrated in FIG. 3, the outlet ports 74 are arranged along the sheet ejection path, and disposed between each pair of adjacent ones of the ribs 73 arranged in the left-right direction. The outlet ports 74, disposed between each pair of adjacent ribs 73, are disposed on either side, in the left-right direction, relative to a supporting wall portion 75 provided with a spindle that rotatably supports a lower roller 57 of the sheet ejection rollers 51 described later.

Furthermore, as illustrated in FIG. 1, the outlet ports 74 are positioned closer to the downstream end of the first guide member 71 than to the upstream end of the first guide member 71. The inlet port 27 in the bottom wall 63 of the first accommodating portion 26 is disposed below the circuit substrate 65 and the motor 67 and on the rear side with respect to the outlet ports 74.

As illustrated in FIG. 1, the circuit substrate 65 is disposed directly below the outlet ports 74. Furthermore, the motor 67 is disposed on a diagonal line connecting the outlet ports 74 and the inlet port 27 to each other.

With such a positional relationship, air that has flowed into the first accommodating portion 26 from the inlet port 27 passes through the first accommodating portion 26 from one corner to another corner on the opposite side while traversing the center portion of the first accommodating portion 26; accordingly, air sufficiently touches the circuit substrate 65 and the motor 67 that are accommodated in the first accommodating portion 26. Accordingly, heat generated by the circuit substrate 65 and the motor 67 can be discharged efficiently.

As illustrated in FIG. 2, the upper side of the sheet ejection path 70 is constituted by a second guide member 76 that is disposed on a backside of a cover 25 extending in the horizontal direction and constituting the upper surface of the housing 2.

Specifically, the second guide member 76 is formed of a backside 25*a* of the cover 25 facing the first guide member 71, and a plurality of ribs 29 that extends downward from the backside 25*a*.

There are no openings in the upper surface of the cover 25 in order to protect the housing 2 from liquid, such as water.

The sheet ejection rollers 51 are disposed in the sheet ejection opening 53 at the downstream end portion of the sheet ejection path 70.

As illustrated in FIG. 1, the nipping position of the sheet ejection rollers 51 are set at a position higher than the uppermost portion of the heating roller 46A of the fixing unit 46.

As illustrated in FIGS. 2 and 3, the sheet ejection rollers 51 are disposed at an upper front portion inside the housing 2 and include a plurality of pairs of rollers 55 and 57 (only a single pair of rollers 55 and 57 is illustrated in the cross-sectional perspective view of FIG. 3). The plurality of pairs of the rollers 55 and 57 are arranged in the left-right direction (the axial direction of the photosensitive drum 41) to eject the sheet S fed from the fixing unit 46 to the outside of the housing 2.

Specifically, upper rollers 55 are rotatably supported by the housing 2 through a shaft 56, and the lower rollers 57 are rotatably supported by the supporting wall portions 75 that are disposed on the base portion 72 between the ribs 73 of the first guide member 71. In the present embodiment, there are gaps in the sheet ejection opening 53 between the shaft 56 and the base portion 72. Via the gaps, the inside of the housing 2 communicates with the outside.

A function of the above-configured laser printer 1 of discharging heat that has been generated by the fixing unit 46, the circuit substrate 65, the motor 67, and the like will be described.

As illustrated in FIG. 1, air that has been heated by the heating roller 46A of the fixing unit 46 ascends by natural convection, flows into the sheet ejection path 70, passes through the sheet ejection opening 53, and is then discharged to the outside of the housing 2. In this manner, an airflow AF1, which flows from the fixing unit 46 to the outside of the housing 2 through the sheet ejection path 70 and the sheet ejection opening 53, is generated inside the housing 2 by natural convection.

Furthermore, when the sheet S passes through the sheet ejection path 70 from the fixing unit 46 towards the sheet ejection opening 53, the air around the sheet S moves together with the sheet S and, accordingly, an airflow AF2 is generated. In other words, the airflow AF2 produces an effect of strengthening the airflow AF1.

Air heated by the heat, which is generated by the circuit substrate 65 and the motor 67, ascends inside the first accommodating portion 26 by natural convection. In this manner, an airflow AF3 flowing from the circuit substrate 65 and the motor 67 to the outlet ports 74 is generated inside the first accommodating portion 26 by natural convection. The airflow AF3 is drawn into the airflows AF1 and AF2 that flow through the sheet ejection path 70, flows into the sheet ejection path 70 through the outlet ports 74, and is guided to the outside of the housing 2 by the airflows AF1 and AF2.

Since the first guide member 71 includes the ribs 73, the undersurface of the sheet S does not come in contact with the base portion 72 of the first guide member 71. Accordingly, exhaust passages through which the airflow AF1 flowing from the fixing unit 46 passes are provided between the sheet S and the base portion 72, and the sheet S does not block the outlet ports 74. Thus, airflow AF3 from the heat generating members can be made to flow efficiently.

In this manner, heat that has been generated in the circuit substrate 65 and the motor 67 that are accommodated inside the first accommodating portion 26 where flow of air is not easily formed can be efficiently cooled and discharged by using natural convection.

Furthermore, since a fan for cooling the heat generating members is not required, the housing can be downsized.

Furthermore, the inlet port 27 is disposed in the bottom wall 63 of the first accommodating portion 26 at a position lower than the heating roller 46A of the fixing unit 46. Thus, the circuit substrate 65 and the motor 67 that are accommodated in the first accommodating portion 26 can be cooled in a further efficient manner by drawing low-temperature air in from the inlet port 27.

Furthermore, the inlet port 27 and the outlet ports 74 are disposed on the diagonal line of the first accommodating portion 26. Thus, the inside of the first accommodating portion 26 can be cooled efficiently.

Moreover, since the inlet port 27 is disposed at a position above and opposing the developing cartridge 44, air around the developing cartridge 44 can be drawn into the first accommodating portion 26. Accordingly, the developing cartridge 44 can be cooled efficiently.

With the above configuration, the following effects can be obtained in the present embodiment. The laser printer 1 includes the fixing unit 46 that thermally fixes the toner image formed on the sheet S, the housing 2 that accommodates the fixing unit 46 and that has the sheet ejection opening 53 to eject the sheet S to the outside, the heat generating members, such as the circuit substrate 65 and the motor 67, which are arranged below the sheet ejection path 70 through which the sheet S passes, the sheet ejection path 70 extending from the fixing unit 46 to the sheet ejection opening 53, and the first guide member 71 that is disposed between the heat generating members and the sheet ejection path 70, the first guide member 71 constituting the lower side of the sheet ejection path 70 and having the outlet ports 74; accordingly, air that has been heated by the heat generating members is drawn into the airflows AF1 and AF2, which flow through the sheet ejection path 70, and flows into the sheet ejection path 70 through the outlet ports 74 disposed in the first guide member 71 and, then, is guided by the airflows AF1 and AF2 to the outside of the housing 2.

Accordingly, the heat from the heat generating members can be discharged efficiently to the outside of the housing 2 by using the airflows AF1 and AF2 that flow through the sheet ejection path 70.

The first guide member 71 includes the base portion 72, which faces the sheet S, and the plurality of ribs 73, which protrudes upwards from the base portion 72 and extends along the sheet ejection path 70. The base portion 72 has the outlet ports 74, which are arranged along the sheet ejection path 71 and disposed in the base portion 72 between each pair of adjacent ones of the ribs 73. Thus, the plurality of ribs 73 guide the undersurface of the sheet S that passes through the sheet ejection path 70 such that the exhaust passages having a height equivalent to the height of the ribs 73 can be provided between the base portion 72 and the sheet S. Accordingly, heat can be discharged efficiently.

The protruding amount of each rib 73 from the base portion 72 is larger at the downstream end of the first guide member 71 positioned toward the sheet ejection opening 53 than at the upstream end of the first guide member 71 positioned toward the fixing unit 46; accordingly, the sheet S that passes through the sheet ejection path 70 can be fed in a stable manner and the exhaust passages can be provided on the undersurface side of the sheet S.

Since the outlet ports 74 are positioned closer to the downstream end of the first guide member 71 than to the upstream end thereof, exhaust passages each having a sufficient height can be provided between the undersurface of the sheet S and the outlet ports 74 such that even if air that has been heated by the heat generating members flows into the exhaust passages through the outlet ports 74, the airflows AF1 and AF2 do not stagnate inside the exhaust passages; accordingly, heat can be discharged in a stable manner.

In the first guide member 71, the first guide member 72 is inclined downwards from near the fixing unit 46 toward the sheet ejection opening 53. The sheet ejection opening 53 for ejecting the sheet S guided by the ribs 73 can be positioned lower and as a result, the housing 2 can be downsized without loss of the exhaustion efficiency of the heat from inside the housing 2.

Since the sheet ejection rollers 51 are disposed in the sheet ejection opening 53, force feeding the sheet S can be given to the sheet S passing through the sheet ejection path 70; accordingly, the airflow AF2 that is generated by feeding of the sheet S can be created actively to further efficiently discharge heat from the heat generating members.

Since the circuit substrate 65 is disposed directly below the outlet ports 74, the air heated by the circuit substrate 65 can be efficiently discharged by taking advantage of heated air rising, which is an example of natural convection.

The housing 2 includes the first accommodating portion 26 that accommodates the heat generating members and the first accommodating portion 26 has the inlet port 27 at a position lower than the outlet ports 74. Thus, heat from the heat generating members accommodated in the first accommodating portion 26 can be discharged in a further efficient manner.

The housing 2 includes, below the first accommodating portion 26, the second accommodating portion 28 that accommodates the sheet S therein, and the inside of the first accommodating portion 26 communicates with the inside of the second accommodating portion 28 via the inlet port 27; accordingly, heat from the heat generating members accommodated inside the first accommodating portion 26 can be discharged in a further efficient manner and air can be drawn into the first accommodating portion 26 in an efficient manner.

Since the circuit substrate 65 and the motor 67 are included in the heat generating members, heat can be discharged efficiently from the circuit substrate 65 and the motor 67 other than the fixing unit 46 from which heat needs to be discharged.

The laser printer 1 includes the cover 25 that covers an upper portion of the fixing unit 46 and that forms the exterior portion of the housing 2, and the cover 25 includes the second guide member 76 that faces the first guide member 71 and that defines the upper side of the sheet ejection path 70. Thus, the upper surface of the sheet S on which an image has been fixed at the fixing unit 46 can be guided by the second guide member 76; accordingly, the sheet S can be guided towards the sheet ejection opening 53 more reliably with the first guide member 71 and the second guide member 76.

Since the upper surface of the cover 25 extends horizontally from near the fixing unit 46 toward the sheet ejection opening 53, heat from the heat generating members can be discharged efficiently and the housing 2 can be downsized.

An embodiment of the disclosure has been given above; however, the disclosure is not limited to the embodiment described above. Any modifications of the specific configurations can be made, as appropriate, that does not depart from the scope of the disclosure.

For example, in the embodiment described above, the nipping position of the sheet ejection rollers 51 is set at positions higher than the uppermost portion of the heating roller 46A of the fixing unit 46; however, within the range that allows the desired heat exhaust efficiency to be obtained, the nipping position can be set at a height lower than the uppermost portion of the heating roller 46A of the fixing unit 46.

With the above configuration, the height of the laser printer 1 can be lowered further.

In the embodiment described above, the upper surfaces of the plurality of ribs 73 constitute the guide portion configured to guide the sheet S, and the guide portion gradually inclines downwards from near the fixing unit 46 towards the sheet ejection opening 53; however, the guide portion may gradually incline upwards from near the fixing unit 46 towards the sheet ejection opening 53.

With the above configuration, since air that has been heated by the fixing unit 46 is guided towards the sheet ejection opening 53 while ascending along the guide portion that gradually increases its height, the heat exhaust efficiency of the fixing unit 46 can be improved by utilizing natural convection in a further effective manner.

The above embodiment shows, but is not limited to the laser printer 1 illustrated as an example of the image forming apparatus. For example, the image forming apparatus may be any of other image forming apparatuses such as a copying machine and a multifunction printer, which includes a document reader, such as a flatbed scanner.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a sheet, comprising:

a fixing unit configured to fix a toner image formed on the sheet by heat;

a housing accommodating the fixing unit and having a sheet ejection opening through which the sheet is ejected to an outside of the housing, the housing defining a sheet ejection path through which the sheet passes, the sheet ejection path extending from the fixing unit to the sheet ejection opening;

a plurality of sheet ejection rollers disposed in the sheet ejection opening and configured to eject the sheet fed from the fixing unit to the outside of the housing;

a heat generating member spaced apart from the fixing unit and disposed below the sheet ejection path, the heat generating member being configured to generate heat; and a first guide member disposed above the heat generating member and defining a lower side of the sheet ejection path, the first guide member being configured to guide the sheet fed from the fixing unit to the ejection rollers, the first guide member including:

a base portion having a plurality of outlet ports positioned closer to a downstream end of the base portion than to an upstream end thereof, the outlet ports including a first outlet port and second outlet port;

a plurality of ribs protruding upward from the base portion and extending along the sheet ejection path, the ribs being configured to guide the sheet passing through the sheet ejection path; and a supporting portion rotatably supporting one of the sheet ejection rollers, wherein the ribs include a first rib, a second rib, a third rib, and a fourth rib, which are arranged in a direction perpendicular to the sheet ejection path, wherein the first outlet port is located between the first rib and the second rib, wherein the one of the sheet ejection rollers is disposed between the second rib and the third rib, and wherein the second outlet port is located between the third rib and the fourth rib.

2. The image forming apparatus according to claim 1, wherein the outlet ports extend in the direction perpendicular to the sheet ejection path.

3. The image forming apparatus according to claim 1, wherein the outlet ports and a second set of the outlet ports are arranged along the sheet ejection path.

4. The image forming apparatus according to claim 1, wherein a protruding amount of each of the ribs from the base portion is larger at the downstream end of the first guide member than at the upstream end of each rib.

5. The image forming apparatus according to claim 1, wherein the base portion of the first guide member is inclined downwards toward the sheet ejection opening.

6. The image forming apparatus according to claim 1, wherein the heat generating member is disposed directly below the outlet ports of the first guide member.

7. The image forming apparatus according to claim 1, wherein the housing includes a first accommodating portion accommodating the heat generating member, and wherein the first accommodating portion has an inlet port disposed at a position lower than the outlet ports of the first guide member.

8. The image forming apparatus according to claim 7, wherein the housing includes a second accommodating portion disposed below the first accommodating portion and configured to accommodate the sheet, and wherein the second accommodating portion communicates with the first accommodating portion via the inlet port of the first accommodating portion.

9. The image forming apparatus according to claim 1, wherein the heat generating member includes a circuit substrate having a plurality of electronic components mounted thereon.

10. The image forming apparatus according to claim 1, wherein the heat generating member includes a motor configured to supply driving force to the fixing unit.

11. The image forming apparatus according to claim 1, further comprising a cover covering an upper portion of the fixing unit and forming an exterior portion of the housing, wherein the cover includes a second guide member facing the first guide member and defining an upper side of the sheet ejection path.

12. The image forming apparatus according to claim 11, wherein the cover extends horizontally from the fixing unit toward the sheet ejection opening.

* * * * *